US012090418B1

(12) United States Patent
Lindberg et al.

(10) Patent No.: US 12,090,418 B1
(45) Date of Patent: Sep. 17, 2024

(54) TOY PLAY SET AND PACKAGING THEREFOR

(71) Applicant: Mattel, Inc., El Segundo, CA (US)

(72) Inventors: Kelley Lindberg, Los Angeles, CA (US); Isaac Luk, Torrance, CA (US); Kenna O'Brien, Redondo Beach, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 18/470,639

(22) Filed: Sep. 20, 2023

(51) Int. Cl.
*A63H 3/00* (2006.01)
*A63H 3/46* (2006.01)
*A63H 3/52* (2022.01)

(52) U.S. Cl.
CPC ..... *A63H 3/005* (2013.01); *A63H 3/46* (2013.01); *A63H 3/52* (2013.01)

(58) Field of Classification Search
CPC .. A63H 3/00; A63H 3/36; A63H 33/22; A61J 1/2093; B65D 51/2814; B65D 51/2828; B65D 51/2835; B65D 81/3211
See application file for complete search history.

(56) References Cited

U.S. PATENT DOCUMENTS 1,585,912 A * 5/1926 Heublein ..... B65D 81/3277 604/416
2,404,316 A * 7/1946 Sack ..... A61M 5/284 604/416
3,915,296 A * 10/1975 Spencer ..... A47G 19/2205 206/217
3,921,801 A 11/1975 Sway
4,408,690 A * 10/1983 Ferrero ..... B65D 77/24 215/388
4,693,366 A * 9/1987 Goncalves ..... B65D 81/3211 215/DIG. 8
4,798,288 A 1/1989 Holzner
4,998,671 A 3/1991 Leifheit
5,176,634 A 1/1993 Smith
5,236,384 A * 8/1993 Fabricant ..... A63H 3/36 273/291
5,419,429 A * 5/1995 Zimmerman ..... B65D 51/2878 215/229

(Continued)

FOREIGN PATENT DOCUMENTS

CA 2099488 A1 4/1994
CA 2435668 A1 9/2002

(Continued)

*Primary Examiner* — John A Ricci
(74) *Attorney, Agent, or Firm* — Edell, Shapiro & Finnan, LLC

(57) ABSTRACT

Toy packaging is made up of two compartments. The first compartment removably contains a toy and the second compartment includes a breakable seal to removably contain a substance in the second compartment. When the breakable state is in a broken state, such as after a piercing element of the toy set enters the second compartment and breaks the breakable seal, the substance is dispensed from the second compartment into the first compartment where the toy is contained. The substance is dispensed onto the toy and obscures an overall appearance of the toy, at least partially. This creates a surprise element for the toy set since the user must remove the toy from the substance to see the toy.

20 Claims, 9 Drawing Sheets

(56) References Cited

U.S. PATENT DOCUMENTS

| | | | | |
|---|---|---|---|---|
| 5,639,245 | A * | 6/1997 | McMains | G09B 19/00 446/87 |
| 5,772,017 | A * | 6/1998 | Kang | B65D 51/2842 426/115 |
| 5,813,895 | A * | 9/1998 | Cho | G09B 23/36 446/385 |
| 5,897,418 | A * | 4/1999 | Spector | A63H 3/06 446/268 |
| 5,928,213 | A | 7/1999 | Barney | |
| 6,092,658 | A * | 7/2000 | Pietrafesa | B65D 81/365 446/72 |
| 6,357,619 | B1 * | 3/2002 | Schaefer | B65D 47/06 220/709 |
| 6,902,335 | B2 | 6/2005 | Bergey | |
| 7,055,683 | B2 | 6/2006 | Bourque | |
| 7,147,880 | B2 * | 12/2006 | Lenahan | B65D 81/3238 426/115 |
| 7,306,095 | B1 | 12/2007 | Bourque | |
| 7,921,993 | B1 * | 4/2011 | Zammit | B65D 51/225 215/DIG. 8 |
| 9,061,819 | B2 | 6/2015 | Kane, Jr. | |
| 11,607,621 | B2 | 3/2023 | O'Brien | |
| 2006/0171970 | A1 | 8/2006 | Karl | |
| 2008/0202951 | A1 | 8/2008 | Landolt | |
| 2011/0210143 | A1 | 9/2011 | Jones | |
| 2011/0272379 | A1 | 11/2011 | Eghbaly | |
| 2014/0027325 | A1 | 1/2014 | Takeuchi | |
| 2016/0106519 | A1 | 4/2016 | Hashiguchi | |
| 2020/0108326 | A1 * | 4/2020 | Pyo | A63H 33/003 |

FOREIGN PATENT DOCUMENTS

| | | | |
|---|---|---|---|
| CA | 2612104 | A1 | 12/2006 |
| CA | 2629089 | A1 | 5/2007 |
| CA | 2550231 | A1 | 12/2007 |
| CA | 2805727 | C | 1/2019 |

* cited by examiner

TOY PLAY SET AND PACKAGING THEREFOR

FIELD OF THE INVENTION

The present application relates generally to toys and/or figurines and, in particular, to packaging for toys/figurines that can reveal an appearance of a toy and/or figurine.

BACKGROUND

Through the years, toys and/or figurines (for simplicity, referred to herein as toys) have provided amusement and entertainment for children. That is, toys have some inherent play value. To increase this play value, various features, such as action or movement features, have been incorporated into some toys (e.g., so that toys can appear to walk, crawl, talk, move etc.).

Additionally, or alternatively, some toys allow a user to modify the appearance of the toy. For example, a toy figurine might include thermochromic hair, layered clothing, features that move to "transform" the doll (e.g., from a mermaid to a princess), or other such appearance changing features. As one example of a figurine with appearance changing features, U.S. Pat. No. 5,032,102, which is issued to Davidson et al. and entitled TOY FIGURE HAVING WATER DISSOLVABLE CLOTHES AND FACIAL ELEMENTS, discloses a doll with a combination of waterproof materials and overlying fabric layers or facial appearance elements formed of a water dissolvable fabric or water dissolvable material, respectively. Thus, when the doll is immersed in water, the dissolvable fabric layers and dissolvable facial appearance elements are dissolved and expose the underlying waterproof elements.

Despite the foregoing, there is a continuing need for ever more interesting and varied doll features, for example, to surprise or entertain a child. For example, while the features of U.S. Pat. No. 5,032,102 may be interesting and engage a user, the features may provide a limited amount of surprise or suspense for the user, as the user can typically see the doll's overall appearance before or during exposure of the underlying waterproof elements.

SUMMARY

A toy, a toy set including a toy, and a toy packaging are presented herein. In at least some embodiments, the toy is placed in a vessel of the toy set. More specifically, the toy is placed in a first compartment of the vessel, and a second compartment of the vessel is removably attached to the first compartment of the vessel. The second compartment of the vessel contains a substance with a breakable seal in an unbroken state. When the breakable seal is in a broken state, the substance is dispensed into the first compartment of the vessel to obscure an overall appearance of contents of the first compartment, at least partially. In at least some embodiments, a piercing element is used to break the breakable seal. Additionally, or alternatively, outer packaging for the toy set may be opaque, so that when it is disposed on the toy packaging, it substantially covers the toy packaging to obscure contents positioned therein. Thus, the toy and/or the packaging presented herein may provide a surprise for the user, adding to the play value of the toy.

According to other embodiments, the present application is directed to toy packaging including a first compartment and a second compartment. A toy may be removably contained in the first compartment and the second compartment may be configured to removably contain a substance. The second compartment also includes a bottom with a breakable seal positioned therein. In a broken state, the breakable seal dispenses the substance into the first compartment to at least partially obscure an overall appearance of contents of the first compartment.

Other systems, methods, features, and advantages will be, or will become, apparent to one with skill in the art upon examination of the following figures and detailed description. All such additional systems, methods, features, and advantages are included within this description, are within the scope of the claimed subject matter.

BRIEF DESCRIPTION OF THE DRAWINGS

The toy set and toy packaging presented herein may be better understood with reference to the following drawings and description. The elements in the figures are not necessarily to scale, emphasis instead being placed upon illustrating the principles of the toy set. In the figures, like-referenced numerals designate corresponding parts throughout the different views.

DETAILED DESCRIPTION

The toy set and/or the toy packaging presented herein includes a substance that adds play value during an opening or unboxing of a toy included in the toy set and/or toy packaging. For example, in at least some embodiments, a toy is placed in a first compartment of a vessel, and a second compartment of the vessel contains a substance with a breakable seal in an unbroken state. The second compartment is removably attached to the first compartment of the vessel in order to selectively close the first compartment. In at least some embodiments, a piercing element may be used to break the breakable seal. Then, when the breakable seal is in a broken state, the substance from the second compartment is dispensed into the first compartment to at least partially obscure an overall appearance of contents of the first compartment. Consequently, a user may not be able to identify the toy when the underlying toy is covered with the substance. Additionally, or alternatively, outer packaging for the toy set may be opaque, so that when it is disposed on the toy packaging, it substantially covers the toy packaging to hide its contents positioned therein from view. Thus, the toy set and/or the packaging presented herein may provide a surprise for the user, adding to the play value of the toy.

Figure 1:
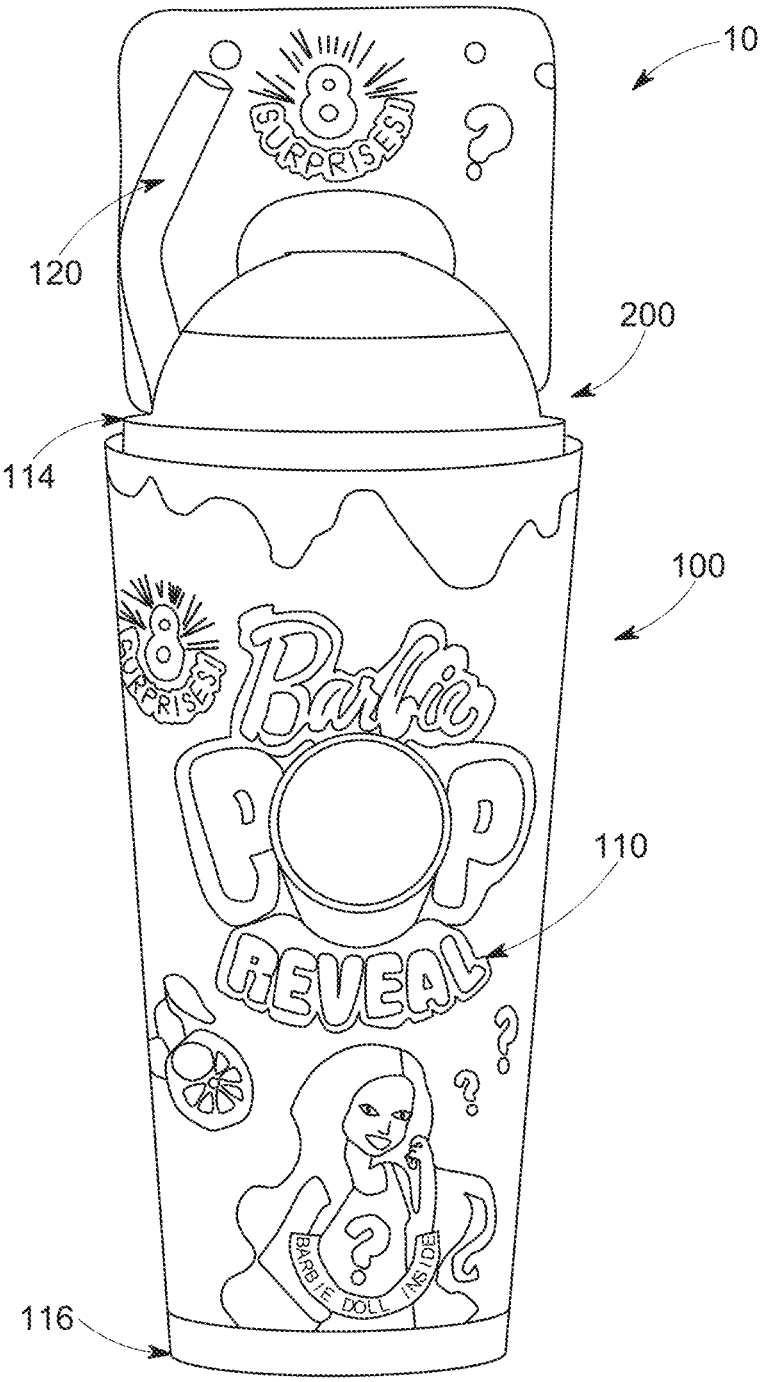
FIG. 1 is a front view of an example embodiment of a toy set including an example embodiment of the opaque outer packaging.
Figure 2:
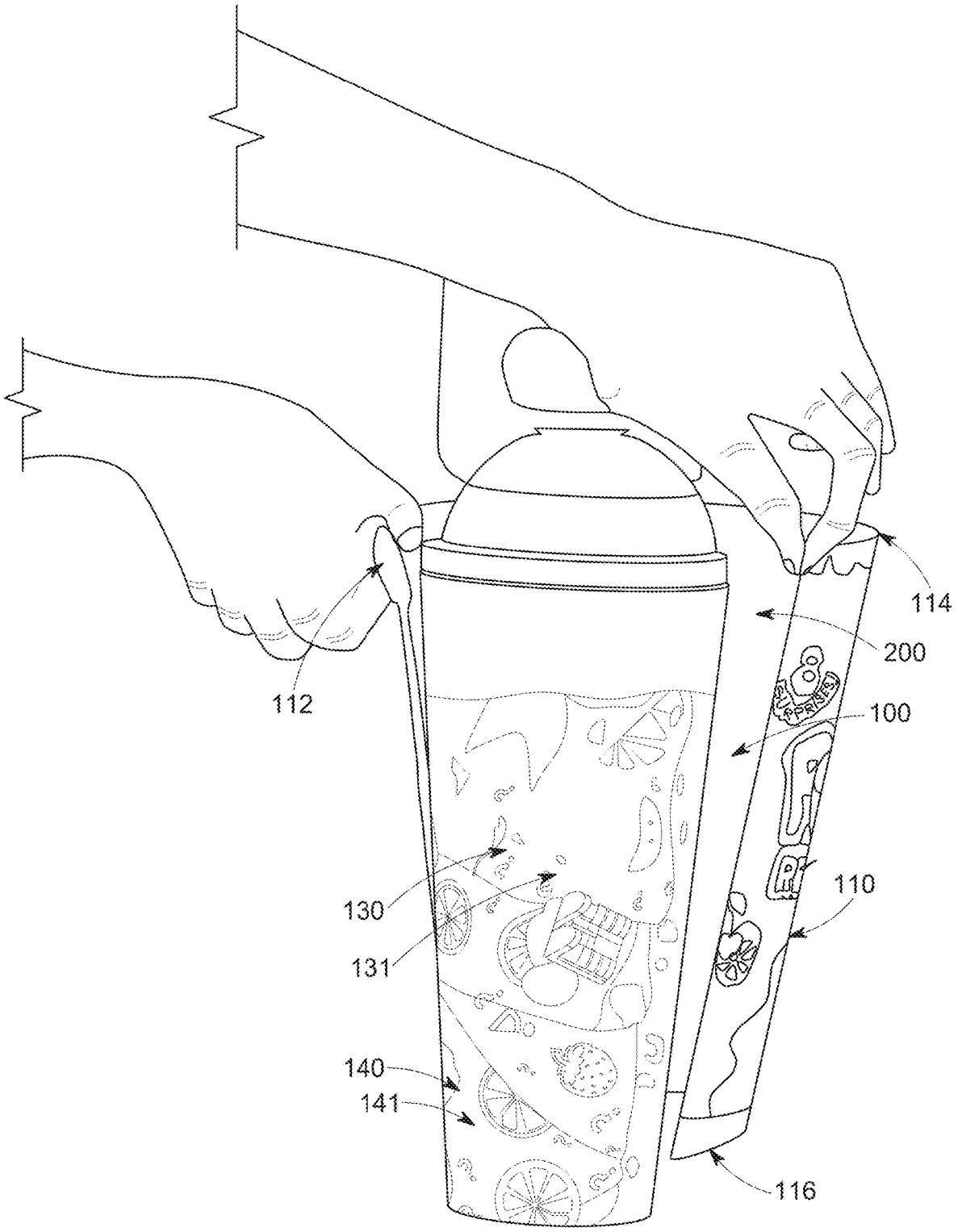
FIG. 2 is a front view of the toy set of FIG. 1 while packaging included in the toy set is being opened.

FIGS. 1 and 2 depict an example embodiment of a toy set 10 that includes surprise elements. At a high-level, the toy set 10 includes toy packaging 100 with outer packaging 110 and a vessel 200 within which a toy 130 may be packaged, perhaps alongside accessories 140. In other embodiments, however, the toy 130 may not be packaged alongside accessories 140. Additionally, or alternatively, the toy 130 may be packaged within toy packaging 131 (often referred to simply as packaging 131), perhaps alongside accessories 140 that may be packaged within accessory packaging 141 (often referred to simply as packaging 131). In at least some of these embodiments, packaging 131 and/or packaging 141 may at least partially obscure or hide the toy 130 and accessories 140, respectively.

To be clear, the term "obscure" is used to denote that something is at least partially concealed. Thus, an obscured portion of a toy may not be visible from one or more perspectives. For example, when the toy 130 is packaged within packaging 131 that is opaque, such as in the depicted embodiment, the packaging 131 may hide/obscure the identity of the toy 130. Similarly, in the depicted embodiment, the accessories 140 are packaged within opaque packaging 141 that hides/obscures the identity of the accessories 140. This provides a surprise element for the user, since even after removing the outer packaging 110 the user (e.g., the child) may be unable to ascertain the toy 130 they have obtained (e.g., purchased). The term "opaque" is used herein to denote that something is not able to be seen through. In some embodiments, packaging 131 of the toy 130 may match the packaging 141 of the accessories 140.

Figure 3:
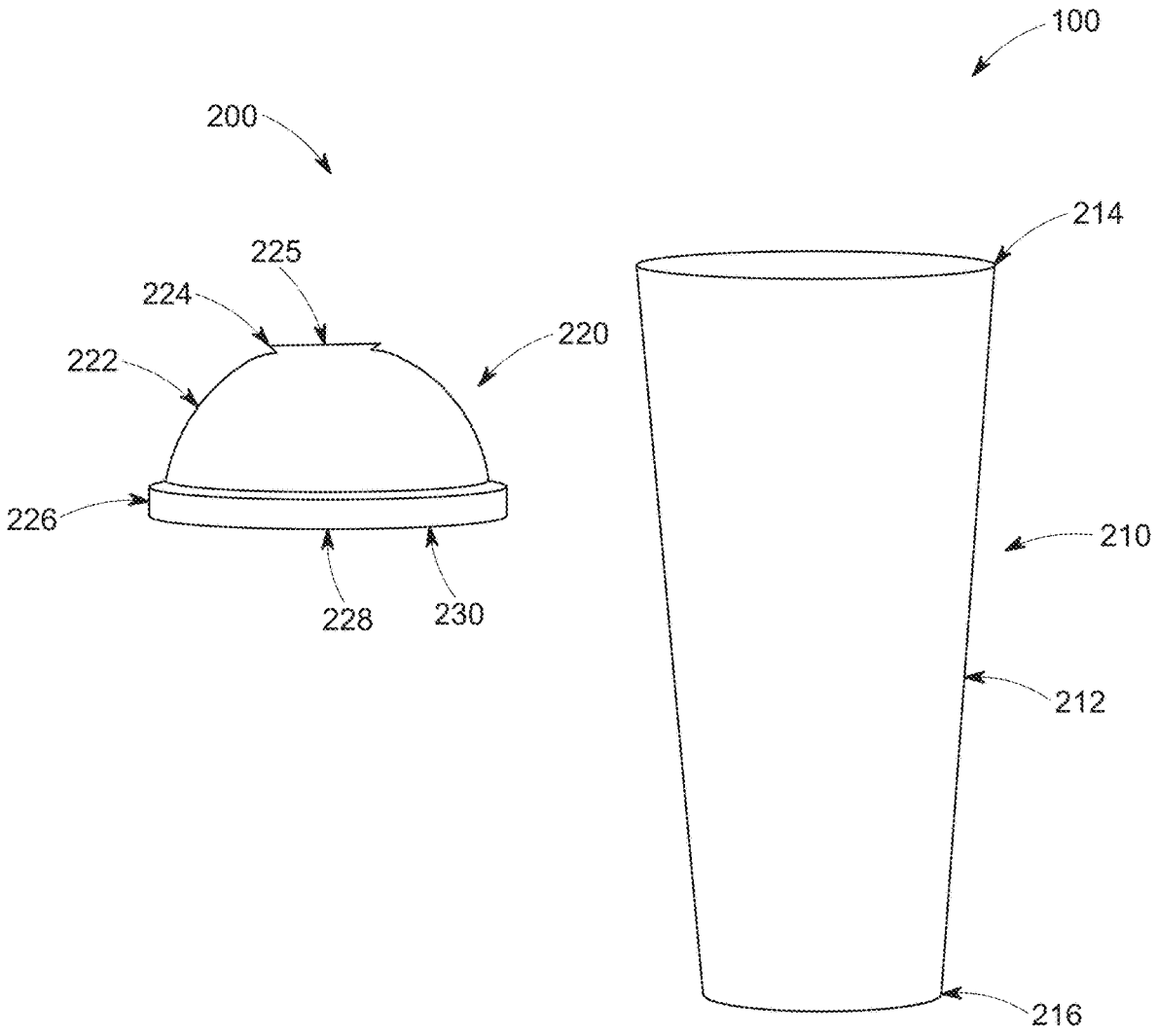
FIG. 3 is a front view of an example embodiment of the opaque outer packaging of FIG. 1.

Still referring to FIGS. 1 and 2, but now with reference to FIG. 3 as well, in the depicted embodiment, the toy set 10 also includes outer packaging 110 and a piercing element 120. The outer packaging 110 may be an annular element that extends from a top edge 114 to a bottom edge 116. Additionally or alternatively, the outer packaging 110 may be opaque and may substantially cover the sidewall 212 of the first compartment 210 of the vessel 200 so that the toy 130 is hidden from view at a point of sale location, insofar as, in this instance, the term "substantially" is intended to denote coverage of more than 80%, 85%, 90%, 95%, or any other percentage between 70-100% of the sidewall 212.

When the outer packaging 110 is disposed on the vessel 200, the top edge 114 may be positioned adjacent or proximate to the top rim 214 of the first compartment 210 of the vessel 200. Meanwhile, the bottom edge 116 may be positioned adjacent or proximate to a bottom 216 of the first compartment 210 of the vessel 200. As can be seen in FIG. 2, the outer packaging 110 may also include a removal element 112, such as a tear strip and/or a perforation that allows for easy removal of the outer packaging 110. Once the outer packaging 110 is removed from the vessel 200, a user may be able to view an overall appearance of contents of the first compartment 210. Thus, outer packaging 110 may create a first surprise element for the user that reveals the toy set 10 without revealing the entire or overall appearance of the toy 130 (as is explained in further detail below).

In the depicted embodiment, the piercing element 120 is stored at least partially within the outer packaging 110. Thus, a user may access or obtain the piercing element 120 when the user removes the outer packaging 110. Additionally, in the depicted embodiment, the outer packaging 110 allows the toy set 10 to be stored or displayed on a rod. However, in other embodiments, the vessel 200 or outer packaging 110 may also include other elements that facilitate storage and/or display in any desirable manner and/or elements that retain or do not retain the piercing element 120 in any manner (e.g., the piercing element 120 can be coupled to outer packaging 110 in any manner or need not be coupled to outer packaging 110). Similarly, in various embodiments, any portion of toy packaging 100 may incorporate unshown elements like doll stands, play accessories, and the like, in any desirable manner.

FIG. 3 depicts the toy packaging 100 with the outer packaging 110 removed. The toy packaging 100 includes the vessel 200 within which there may be a first compartment 210 and a second compartment 220. Generally, the first compartment 210 is sized to contain a toy 130 while the second compartment 220 is sized to hold a substance 240 (see, e.g., FIGS. 5 and 6). However, the first compartment 210 may also hold the toy 130 with the substance 240, among other items, as is detailed below.

In the depicted embodiment, the first compartment 210 is defined by a sidewall 212, a top rim 214, and a bottom 216. The bottom 216 closes a first end of the sidewall 212 and an opposite end of the sidewall 212 extends to the top rim 214. Thus, the bottom 216 and sidewall 212 collectively define the first compartment that can at least partially enclose a toy 130 and/or receive the substance 240 from the second compartment 220. However, the first compartment 210 need not be defined by only the aforementioned features and, in other embodiments, may have any size or shape, e.g., with more than one sidewall. For example, in some embodiments, the top rim 214 might support a breakable seal so that a piercing element 120 inserted into the second compartment 220 breaks at least one breakable seal on the second compartment 220 and a breakable seal on the first compartment 210.

The second compartment 220 of the depicted embodiment is a cylindrical, half-sphere, defined by a bottom skirt 226, a bottom opening 228, a breakable seal 230, a sidewall 222, and a top 224. At one end, the top 224 includes an opening 225 sized to receive the piercing element 120. In some embodiments, opening 225 may be sealed by a breakable seal, but other embodiments need not include a breakable seal at opening 225. At the other end, the bottom opening 228 is disposed interiorly of the bottom skirt 226. The bottom opening 228 includes the breakable seal 230 positioned therein and configured to form a temporary barrier that spans the bottom opening 228. Thus, the breakable seal 230 may be configured to retain, at least temporarily, a substance or items within the second compartment 220. In the depicted embodiment, the bottom skirt 226 of the second compartment 220 may be removably attachable to the top rim 214 of the first compartment 210 to selectively close the first compartment 210. However, in other embodiments, the second compartment 220 may be removably attachable to the first compartment 210 in any manner and/or with any features or couplings.

Moreover, in the depicted embodiment, the entire vessel 200 is transparent. With such a configuration, a user can watch the substance 240 dispense from the second compartment 220 to the first compartment 210. However, in other embodiments, the vessel 200 may be any size or shape and one or more portions of the vessel 200 may be transparent while one or more other portions are opaque, reflective, etc. In at least some instances, a partially transparent vessel 200 may still enable a user to watch the substance 240 move from the second compartment 220 into the first compartment 210.

Figure 4:
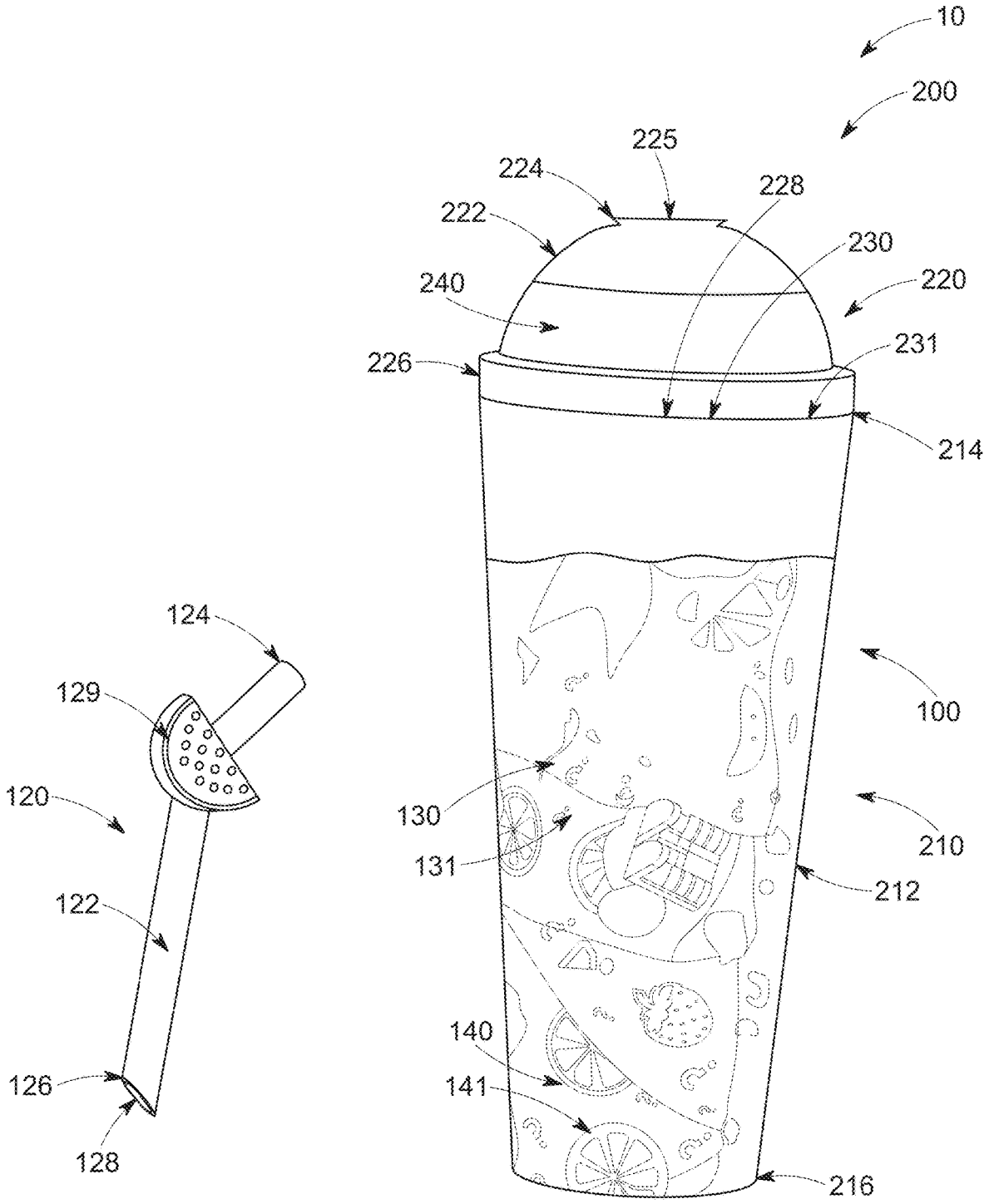
FIG. 4 is a front view of the toy set of FIG. 1 with the outer packaging removed so that the toy is visible through the toy packaging.

FIG. 4 depicts the toy set 10 with the outer packaging 110 removed, according to an example embodiment. In this embodiment, the contents of the vessel 200 are visible through the sidewall 212 of the first compartment 210 after the outer packaging 110 is removed. However, the toy 130 is packaged in packaging 131 and the accessories 140 is packaged in packaging 141, so the identity of the toy 130 and accessories 140 are still hidden or obscured. Additionally, in FIG. 4, the breakable seal 230 spanning the bottom opening 228 of the first compartment 210 is in an unbroken state 231. Thus, the breakable seal 230 retains the substance 240 in the second compartment 220. To change this—i.e., to move the breakable seal 230 to a broken state 232 (see FIG. 6)—a user can pierce the breakable seal 230 with the piercing element 120 after removing the piercing element 120 from the toy set 10 (e.g., from outer packaging 110).

In the depicted embodiment, the piercing element 120 is defined by a sidewall 122, a top 124, and a bottom 126. The sidewall 122 extends from the top 124 to the bottom 126. Moreover, in the depicted embodiment, the piercing element 120 has a solid center 128 (insofar as solid indicates that it is not hollow) to prevent a user (e.g., a child) from ingesting substance 240. However, in other embodiments, the piercing element 120 may be any size or shape and may or may not be hollow, provided that the piercing element 120 is capable of breaking the breakable seal 230 in at least some fashion. For example, the piercing element 120 may be partially hollow to resemble a straw, e.g., from one or both ends, but the hollow sections may be separated or broken by solid sections that prevent a substance from flowing through piercing element 120. The piecing element 120 might also a decorative element 129, such as molded fruit shapes, extending from a portion thereof. In some instances, the decorative element 129 might create a stop that prevents the piercing element from falling into the first compartment 210. A bend in the piercing element 120 may also provide such stop functionality, either with a decorative element or instead of a decorative element (see, e.g., FIG. 5).

In the depicted embodiment, the piercing element 120 is capable of breaking the breakable seal 230 when inserted through the opening 225 of the second compartment 220. This is because an overall length of the piercing element 120 is larger than a height of the second compartment 220. This overall length is a dimension measured along a central axis spanning from bottom 126 to top 124, or vice versa, and includes one bend or turn in the depicted embodiment. But, in other embodiments, a portion of the piercing element 120 may have sufficient length (e.g., may be longer than the second compartment 220) to break the breakable seal 230 and/or may include any desirable feature to render the piercing element 120 capable of breaking the breakable seal 230 (e.g., an extension, telescopic part, etc.). Alternatively, some embodiments of the piercing element 120 might be capable of breaking the breakable seal 230, but only when engaging a bottom surface of the breakable seal 230 (e.g., engaging the breakable seal 230 through the bottom opening 228). Still further, some embodiments of the toy set 10 presented herein might not include a piercing element 120 at all.

Figure 5:
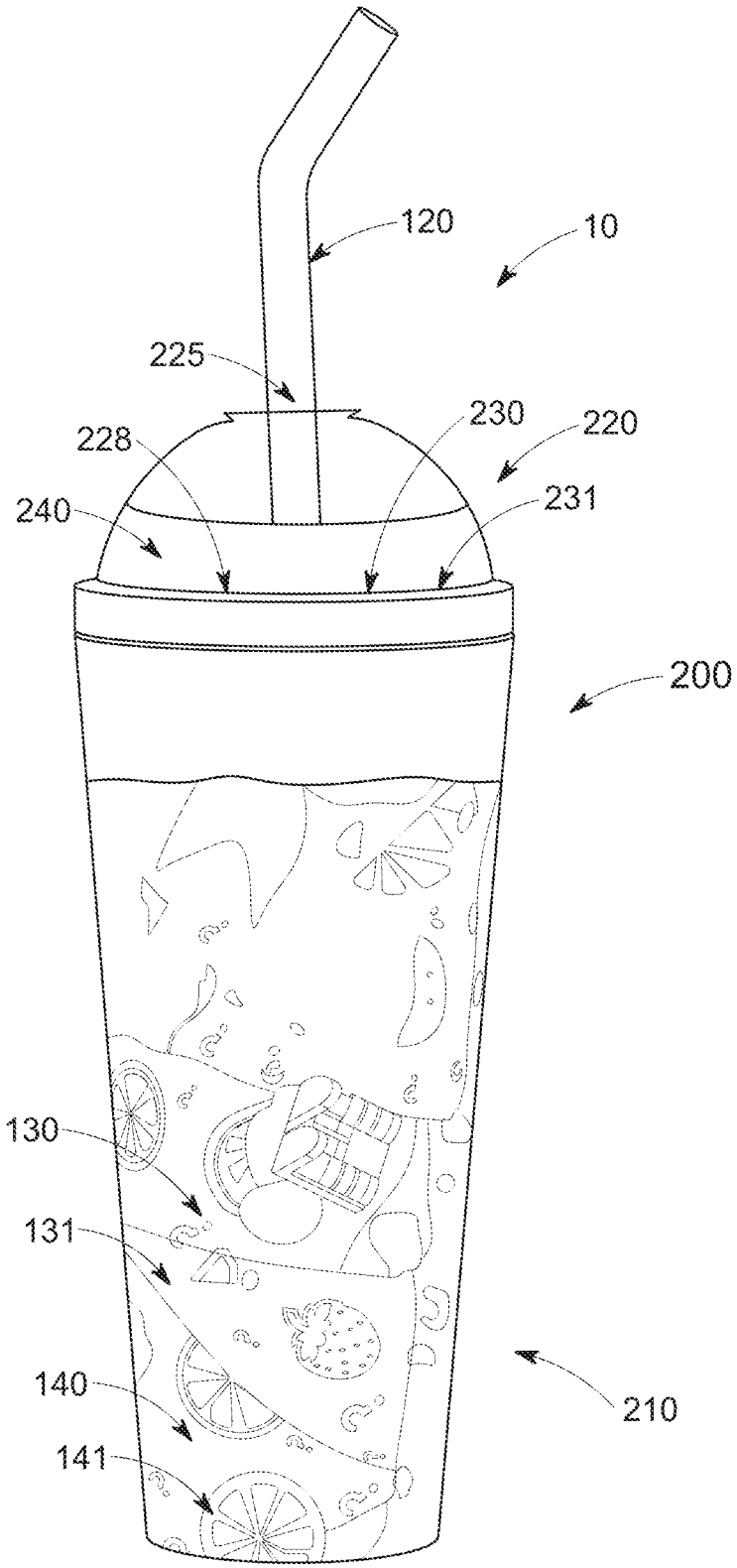
FIG. 5 is a front view of the toy set of FIG. 3 that illustrates a piercing element of the toy set entering a second compartment of the toy set.
Figure 6:
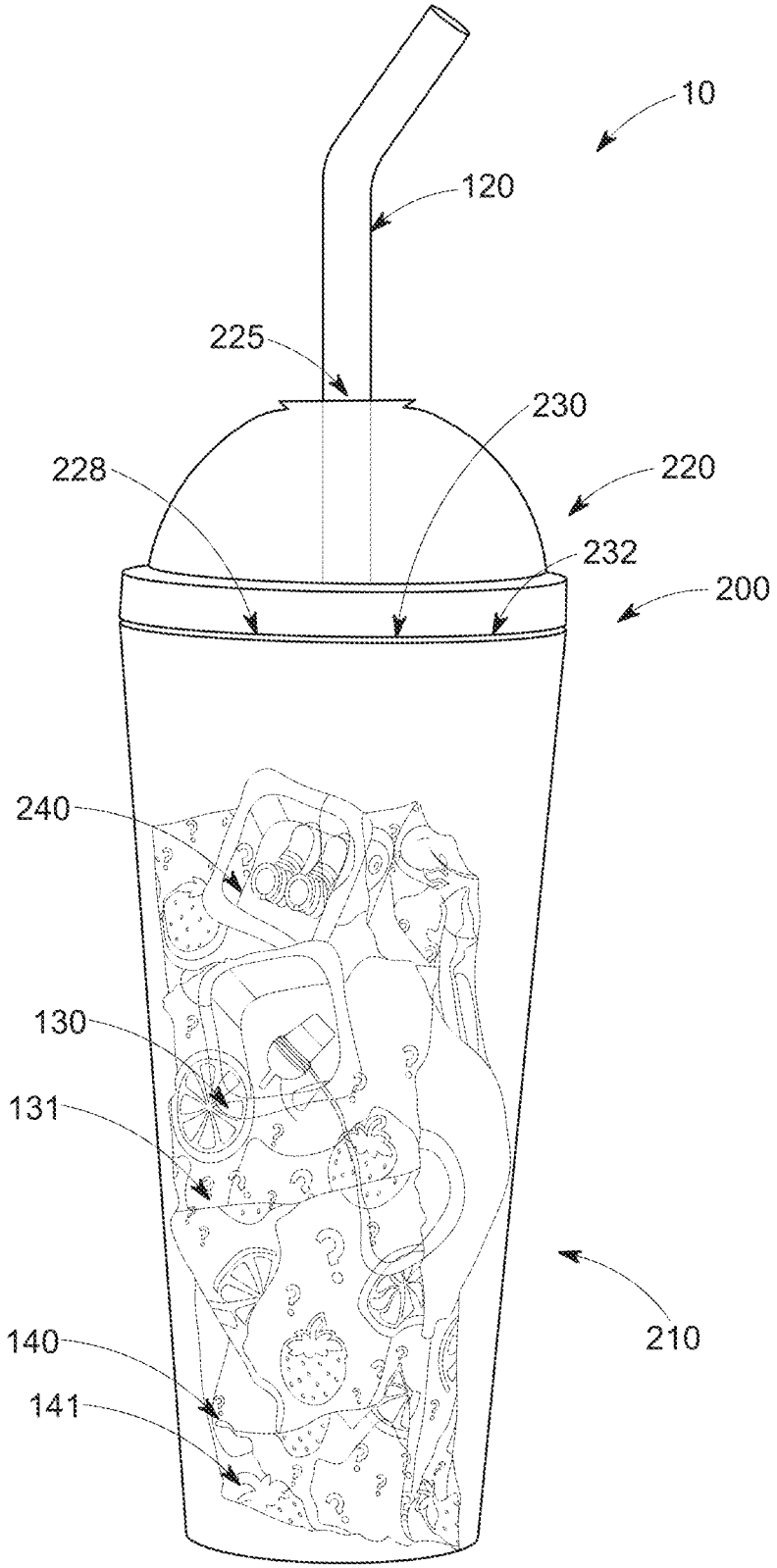
FIG. 6 is a front view of the toy set of FIG. 3 that illustrates the piercing element of the toy set breaking a breakable seal of the second compartment of the toy set and dispensing a substance into a first compartment of the toy set.

Now turning to FIGS. 5 and 6, these figures illustrate an example transformation of the toy set 10 according to an example embodiment. That is, FIGS. 5 and 6 illustrate an example of the piercing element 120 entering the second compartment 220 of the vessel 200 through the opening 225 in the top 224 of the second compartment 220. Then, FIGS. 5 and 6 illustrate an example of the piercing element 120 breaking the breakable seal 230 that is positioned within the bottom opening 228 of the second compartment 220 of the vessel 200.

In the depicted embodiment, the breakable seal 230 goes from an unbroken state 231 to a broken state 232. When the breakable seal 230 is in an unbroken state 231 the substance 240 is removably contained in the second compartment 220 of the vessel 200. When the breakable seal 230 is in a broken state 232, the substance 240 is dispensed from the second compartment 220 into the first compartment 210 of the vessel 200 through the bottom opening 228 of the second compartment 220. In the depicted embodiment, the substance 240 is an opaque slime. The term "slime" is intended to denote a moist, soft, and slippery substance. In other embodiments, however, the substance 240 may be any material and/or may be transparent. In yet other embodiments, the substance 240 may be a foam, liquid, etc. In the depicted embodiment, the substance 240 is dispensed into the first compartment 210 to obscure an overall appearance of contents of the first compartment 210, at least partially. This may create a third surprise element for the toy set 10 (e.g., since the user must remove the toy 130 from the substance 240 to see the toy 130).

Still referring to FIGS. 5 and 6, in the depicted embodiment, the toy 130 is removably contained within the first compartment 210 of the vessel 200. In particular, the toy 130 is packaged within packaging 131 and is removably contained in the first compartment 210 alongside accessories 140 that are packaged within packaging 141. In other embodiments, however, the toy 130 may not be packaged alongside accessories 140. In the depicted embodiment, the toy 130 is packaged within packaging 131, so that the packaging 131 may hide the identity of the toy 130. The accessories 140 are packaged within packaging 141, so that the packaging 141 may hide the identity of the accessories 140. Packaging 131 for the toy 130 and/or packaging 141 for the accessories 140 may be opaque, so that when it is disposed on the toy 130 packaging 131 and/or accessories 140 packaging 141, it substantially covers the toy 130 packaging 131 and/or accessories 140 packaging 141 to hide its contents positioned therein from view. Thus, the toy 130 presented herein may provide another surprise for the user, adding to the play value of the toy 130.

In FIGS. 5 and 6, the toy 130 and the accessories 140 are removably contained in the first compartment 210 of the vessel 200. Thus, once the substance 240 is dispensed into the first compartment 210, onto the toy 130 and the accessories 140, the substance 240 obscures an overall appearance of the toy 130 and the accessories 140, at least partially. This provides the third surprise element for the user (e.g., the child) since the user must remove the toy 130 and the accessories 140 from the substance 240 to see the toy 130 and the accessories 140. It may also add play value to the opening or "unboxing" process. However, the toy 130 and accessories 140 need not both be positioned in the first compartment 210 to achieve this third surprises. For example, in some instances, a user might remove the toy 130 from the first compartment 210 and then puncture the breakable seal 230 to dispense substance 240 onto accessories 140, or a subset of accessories 140 (e.g., only accessories packaged in blister-style containers, while other accessories, such as those in bag-style packaging or those without packaging, are removed prior to dispensing of the substance 240).

Figure 7:
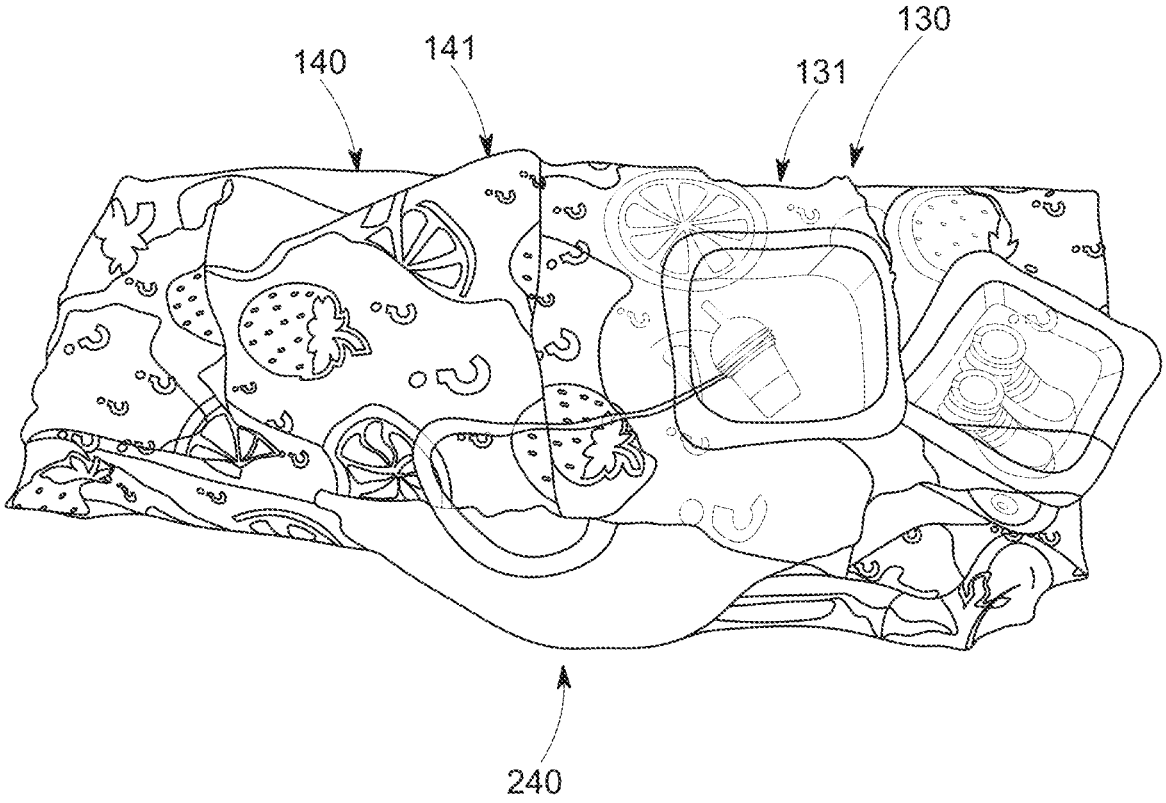
FIG. 7 is a front perspective view of contents of the first compartment after the substance from the second compartment is dispensed into the first compartment.

FIG. 7 depicts contents of the first compartment 210 of the vessel 200 after the substance 240 is dispensed into the first compartment 210 from the second compartment 220. As can be seen, once the substance 240 is dispensed into the first compartment 210, it covers the contents thereof. Thus, when the contents are removed from the first compartment 210, a user may need to dig through the substance 240 to access the toy 130 and/or the accessories 140. However, to reiterate, the substance 240 need not cover the toy 130 and accessories 140 to create this effect.

Figure 8:
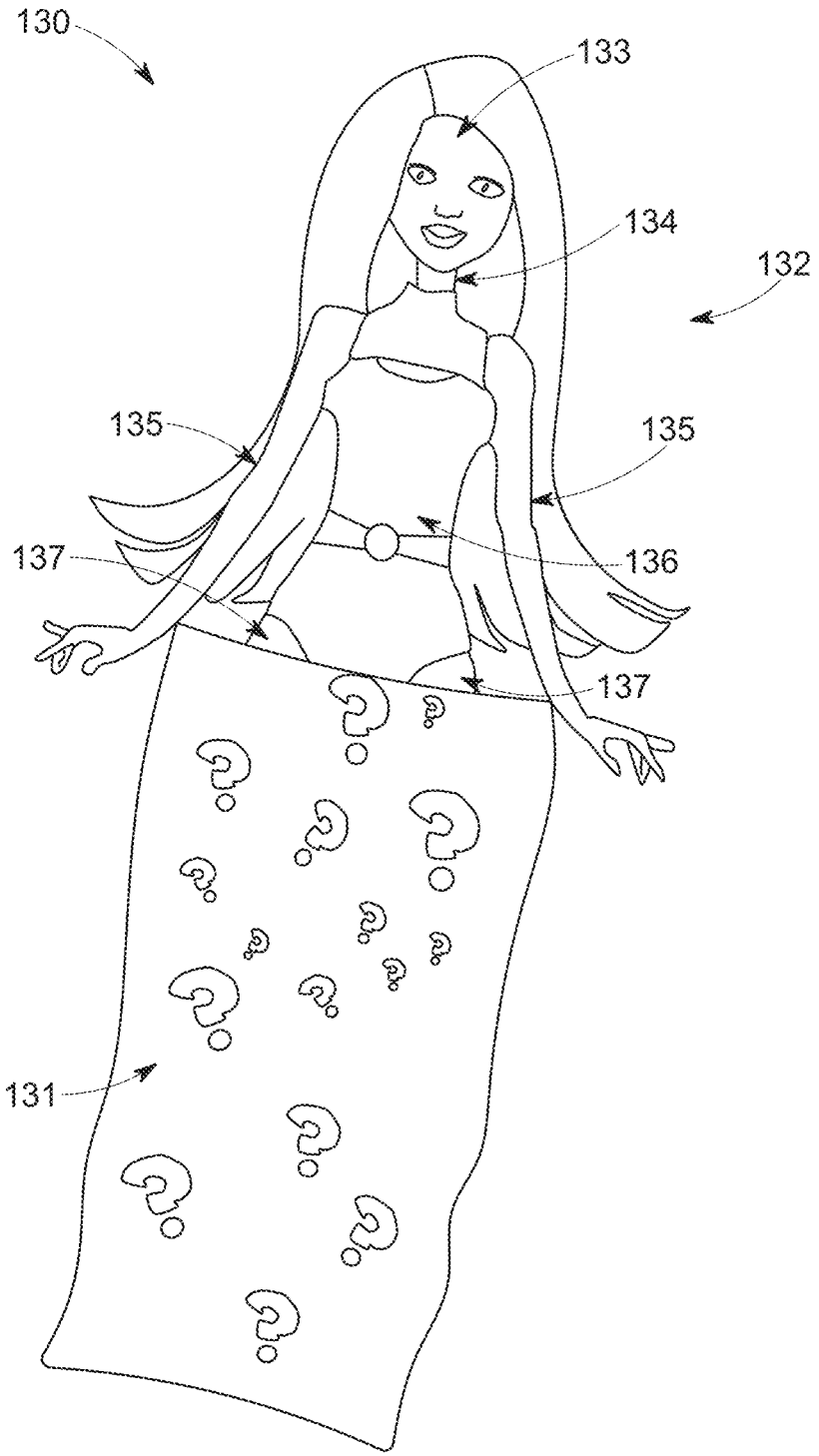
FIG. 8 is a front view of an example embodiment of the toy included in the toy set of FIG. 1, including an example embodiment of obscure packaging.

FIG. 8 depicts an example embodiment of a toy 130 included in the toy set 10 of FIG. 1 and an example embodiment of packaging 131 of the toy 130. Here, the toy 130 is a human figurine 132 that includes a head 133 that is movably mounted on a neck 134, arms 135 that are movably mounted to a torso 136, and legs 137 that are movably mounted to the torso 136. However, in other embodiments, the toy 130 may include any toy (e.g., of any type, style, shape, color, etc.) instead of or in addition to the human figurine 132. That is, although the depicted embodiments illustrate the toy 130 as a human figurine 132, the toy 130 presented herein need not be a human figurine 132. For example, in other embodiments, the toy 130 might be an animal, mythical character, car, truck, etc.

Figure 9A:
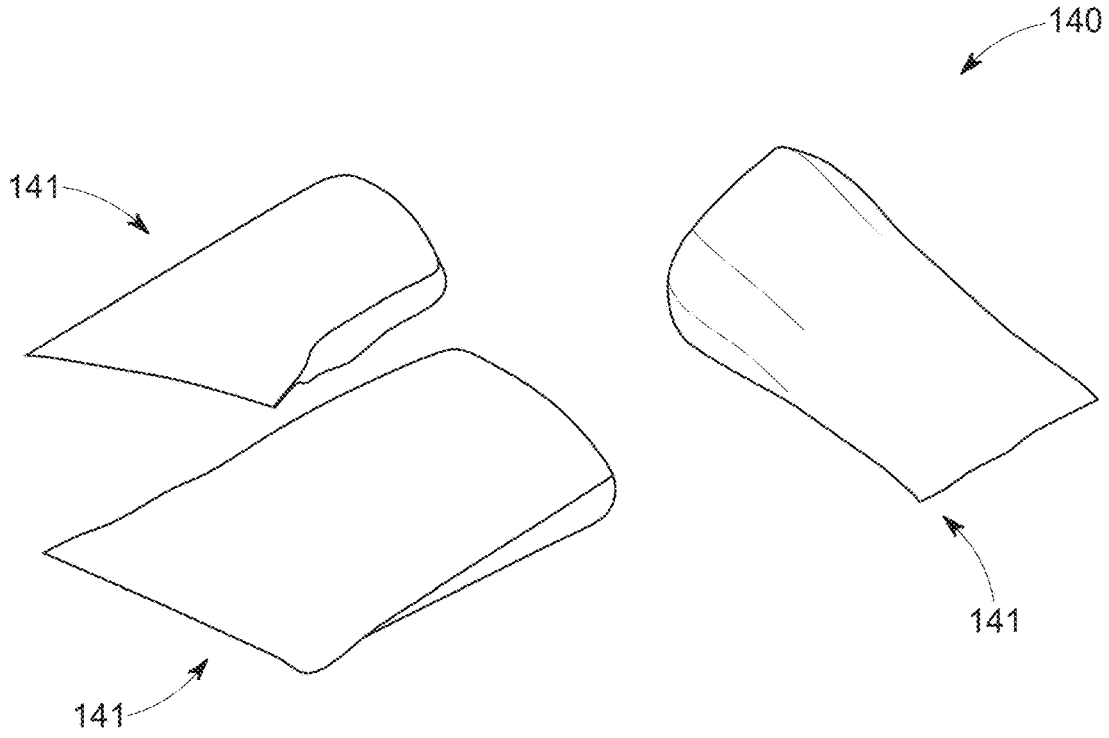
FIGS. 9A and 9B illustrate accessories that may be included in the toy set of FIG. 1.
Figure 9B:
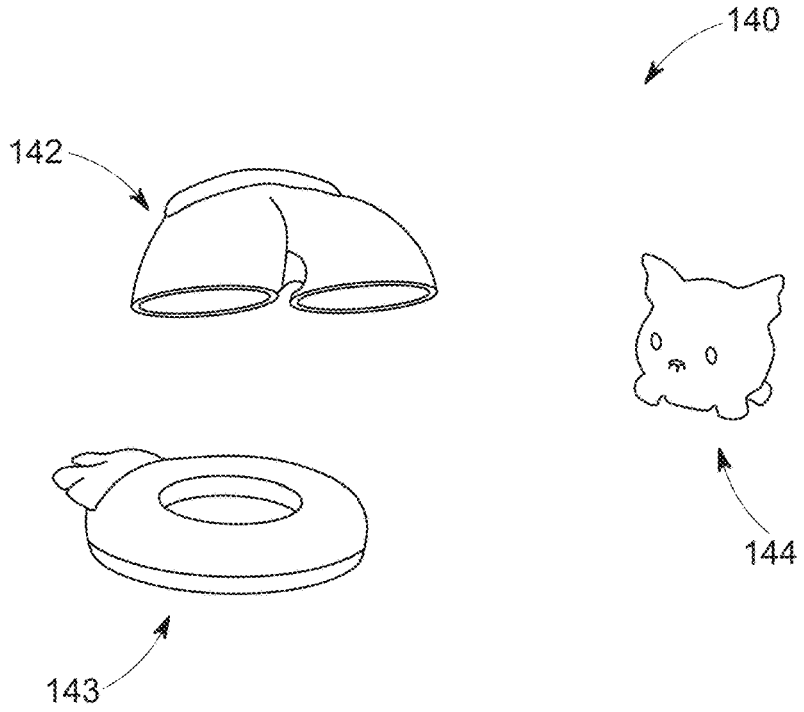

Now turning to FIGS. 9A and 9B, as mentioned, the toy set 10 may include accessories 140. In the depicted embodiment, each of the accessories 140 is packaged within individual packaging 141 that may be stored within the first compartment 210 (e.g., on, below, above, and/or around the toy 130). Packaging the accessories 140 may help to hide the identity of the toy 130 and may provide yet additional elements of surprise within the toy set 10. In the depicted embodiment, the accessories 140 include a pair of shorts 142, a floatation device 143, and a pig 144; however, in other embodiments, the play set may include any accessories (e.g., of any type, style, shape, color, etc.) instead of or in addition to the pair of shorts 142, the floatation device 143, and the pig 144. In at least some embodiments, the pair of shorts 142, the floatation device 143, and the pig 144 included in a particular toy set 10 may complement or coordinate with the overall appearance of the toy 130 that is initially hidden by the toy 130 packaging 131, the substance 240, and the outer packaging 110.

While the toy and packaging presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly, and in a manner consistent with the scope of the disclosure as set forth in the following claims.

It is also to be understood that the toy figurine and packaging described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A toy play set comprising:

a toy packaged in packaging that obscures an identity of the toy;

a vessel comprising:

a first compartment within which the toy may be removably contained; and a second compartment configured to removably contain a substance, the second compartment including a bottom with a breakable seal positioned therein, wherein, in a broken state, the breakable seal dispenses the substance into the first compartment to at least partially obscure an overall appearance of contents of the first compartment; and a piercing element that is capable of breaking the breakable seal.

2. The toy play set of claim 1, wherein the toy comprises a human figurine including a head that is movably mounted on a neck, arms that are movably mounted to a torso, and legs that are movably mounted to the torso.

3. The toy play set of claim 1, wherein the first compartment comprises:

a top rim;

a bottom; and a sidewall extending from the top rim to the bottom.

4. The toy play set of claim 1, wherein the second compartment comprises:

a top;

a bottom skirt;

a bottom opening disposed interiorly of the bottom skirt; and a sidewall extending from the top to the bottom skirt.

5. The toy play set of claim 4, wherein the top of the second compartment comprises an opening sized to receive the piercing element.

6. The toy play set of claim 1, wherein the second compartment is removably attachable to the first compartment to selectively close the first compartment.

7. The toy play set of claim 6, wherein a bottom skirt of the second compartment is attachable to a top rim of the first compartment to removably attach the second compartment to the first compartment.

8. The toy play set of claim 1, wherein at least one of the first compartment and the second compartment is at least partially formed from or covered by opaque materials so that at least one of the first compartment and the second compartment substantially obscures contents stored therein.

9. The toy play set of claim 1, wherein the piercing element has a length that is larger than a height of the second compartment.

10. A toy play set comprising:

a toy;

a vessel comprising:

a first compartment within which the toy may be removably contained; and a second compartment configured to removably contain a substance, the second compartment including a bottom with a breakable seal positioned therein, wherein, in a broken state, the breakable seal dispenses the substance into the first compartment to at least partially obscure an overall appearance of contents of the first compartment; and an opaque outer packaging that, when disposed on the vessel, substantially covers the vessel to obscure contents positioned therein;

accessories packaged in packaging that obscures the accessories so that the packaging and the substance in the second compartment collectively hide an identity of the toy; or both the opaque outer packaging and the accessories.

11. The toy play set of claim 10, further comprising:

a piercing element that is capable of breaking the breakable seal.

12. The toy play set of claim 11, wherein the piercing element has a length that is larger than a height of the second compartment.

13. The toy play set of claim 10, wherein the second compartment is removably attachable to the first compartment to selectively close the first compartment.

14. The toy packaging of claim 13, wherein a bottom skirt of the second compartment is attachable to a top rim of the first compartment to selectively close the first compartment.

15. They toy play set of claim 10, wherein the toy comprises a human figurine including a head that is movably mounted on a neck, arms that are movably mounted to a torso, and legs that are movably mounted to the torso.

16. A toy packaging comprising:

a first compartment within which a toy may be removably contained;

a second compartment configured to removably contain a substance, the second compartment including a bottom with a breakable seal positioned therein, wherein, in a broken state, the breakable seal dispenses the substance into the first compartment to at least partially obscure an overall appearance of contents of the first compartment; and an opaque outer packaging that, when disposed on the toy packaging, substantially covers the toy packaging to obscure contents positioned therein.

17. The toy packaging of claim 16, further comprising:

a piercing element has a length that is larger than a height of the second compartment.

18. The toy packaging of claim 16, wherein the second compartment is removably attachable to the first compartment to selectively close the first compartment.

19. The toy packaging of claim 18, wherein a bottom skirt of the second compartment is attachable to a top rim of the first compartment to selectively close the first compartment.

20. They toy packaging of claim 16, wherein the toy comprises a human figurine including a head that is movably mounted on a neck, arms that are movably mounted to a torso, and legs that are movably mounted to the torso.

* * * * *